313-414 SR
4/8/86 OR 4,581,560

United States Patent [19]
Shirai et al.

[11] Patent Number: 4,581,560
[45] Date of Patent: Apr. 8, 1986

[54] ELECTRON GUN FOR COLOR PICTURE TUBE

[75] Inventors: Shoji Shirai, Koganei; Masaaki Yamauchi, Togane; Kazuo Majima, Mobara; Hiroshi Takano, Hachioji; Masakazu Fukushima, Tokyo, all of Japan

[73] Assignee: Hitachi, Ltd., Tokyo, Japan

[21] Appl. No.: 448,601

[22] Filed: Dec. 10, 1982

[30] Foreign Application Priority Data

| | | | |
|---|---|---|---|
| Dec. 16, 1981 | [JP] | Japan | 56-201617 |
| Dec. 16, 1981 | [JP] | Japan | 56-186349[U] |
| Aug. 25, 1982 | [JP] | Japan | 57-146172 |

[51] Int. Cl.[4] ..... H01J 29/51; H01J 29/62
[52] U.S. Cl. ..... 313/414; 313/460
[58] Field of Search ..... 313/414, 449, 460

[56] References Cited

U.S. PATENT DOCUMENTS

| | | | |
|---|---|---|---|
| 2,859,378 | 11/1958 | Gundert et al. | 313/414 X |
| 3,772,554 | 11/1973 | Hughes | 313/414 X |
| 4,370,592 | 1/1983 | Hughes et al. | 313/460 X |
| 4,429,252 | 1/1984 | Vieland et al. | 313/460 X |
| 4,490,644 | 12/1984 | Shimoma et al. | 313/413 |
| 4,495,439 | 1/1985 | Shimoma et al. | 313/413 X |

FOREIGN PATENT DOCUMENTS

| | | | |
|---|---|---|---|
| 52-70748 | 6/1977 | Japan | 313/414 |
| 54-13769 | 2/1979 | Japan | 313/414 |
| 57-113544 | 7/1982 | Japan | 313/414 |
| 57-151153 | 9/1982 | Japan | 313/414 |

*Primary Examiner*—Palmer C. DeMeo
*Assistant Examiner*—Sandra L. O'Shea
*Attorney, Agent, or Firm*—Antonelli, Terry & Wands

[57] ABSTRACT

An electron gun used in a color picture tube having means for emitting three electron beams toward the fluorescent screen, and main lenses for focusing the electron beams on the fluorescent screen. The main lenses are constituted by two envelopes spaced out from each other and adapted to surround the electron beams, and two electrode plates located on the confronting end surfaces of the envelopes and provided with three apertures aligning on a line for conducting the three electron beams. At least one of the two electrode plates is recessed relative to another electrode plate and disposed inside the envelope, and the recessed electrode plate is structured such that non-rotational symmetry of the lens caused by the recess of the electrode is corrected.

12 Claims, 20 Drawing Figures

ELECTRON GUN FOR COLOR PICTURE TUBE

The present invention relates to an electron gun used in a color picture tube for color television, particularly an in-line electron gun, and more particularly to the structure of electrodes forming the main lens of the electron gun.

One of the influential factors on the focusing characteristics of the color picture tube is the aperture diameter of the main lens of the electron gun. In order to obtain the satisfactory focusing characteristics, it is desirable for the main lens to have as large aperture diameter as possible.

However, in the in-line gun system, three electron guns for green, blue and red are arranged in a unitary member on a horizontal plane, and the in-line electron gun is designed to be placed within the neck which has a limited inner diameter, the diameter of each lens and the interval of the lenses are greatly restricted, making it very difficult to meet the requirement of larger aperture diameter for the main lens.

The problems will further be described in connection with FIG. 1 which is a cross-sectional view of the color picture tube having the conventional electron gun. On the interior wall of a face plate 2 within a glass envelope 1, there is supported a fluorescent screen 3 which is coated with three color phosphors one after another to form the stripes. Cathodes 6, 7 and 8 have respective central axes 15, 16 and 17 which are located coaxially with the corresponding apertures in the first grid (G1) 9, the second grid (G2) 10, the third grid (G3) 11 which partly constitutes the main lens, and a shield cup 13, and also with the central axes of cylinders 20, 21 and 22 fixed inside the apertures of the G3 electrode. The cathodes 6, 7 and 8 are disposed in substantially parallel on the common plane. There is further provided the fourth grid (G4) 12 for completing the main lens which has a central aperture and a cylinder 24 attached therein with their common central axis located coaxially with the above-mentioned central axis 16, and has outer apertures and cylinders 23 and 25 attached therein, respectively, with their respective common axes 18 and 19 slightly deviating outside from the above-mentioned corresponding central axes 15 and 17. The inner diameter of each cylinder is equal to the diameter of the corresponding aperture. Three electron beams originating from the cathodes enter the main lens along the central axes 15, 16 and 17. The G3 electrode 11 has a lower potential than that of the G4 electrode 12 which is in equipotential with the shield cup 13 and a conductive coating 5 provided on the interior wall of the glass envelope 1. The central apertures of the G3 and G4 electrodes have respective common axes to the cylinders 21 and 24, and the cylinders cancel the effect of the non-rotationally symmetrical envelope electrode, resulting in the central lens to be rotationally symmetrical. Consequently, the central beam is focused by the main lens, then takes a straight path along the axis. On the other hand, the outer apertures with associated cylinders 20 and 22 have the eccentric axes with respect to those of the cylinders 23 and 25, respectively, resulting in a formation of outer non-rotationally symmetrical or rotationally asymmetrical lenses. On this account, the outer beams pass through the portions deviating from each lens central axis toward the central beam within the divergent lenses formed by the G4 electrode in the main lens under the converging force toward the central beam as well as under the focusing effect by the main lens. Thus, the three electron beams are focused in an overlapping fashion on a shadow mask 4. This operation for converging three electron beams is called static convergence (STC). The electron beams are further subjected to color selection by the shadow mask 4 so that only components for illuminating fluorescent materials of colors corresponding to the beams are conducted through holes in the shadow mask 4 to the fluorescent screen 3. In order to scan the fluorescent screen by the electron beams, there is provided an external magnetic deflection yoke 14.

Influential factors on the focal characteristics of the picture tube are the magnification and aberration of the main lens which largely depend on the converging effect of the lens. In the picture tube, once the scanning area and maximum deflection angle of the electron beams are given, the distance from the main lens to the focal surface is determined. If the converging effect of the lens is weakened on condition that the distance from the main lens to the focal surface is constant, the magnification of the lens is reduced, and if a condition is added for suppressing the spread of the beam in the lens within a certain value in order to prevent an increased aberrations due to deflection, the incident angle of the beam on the main lens is reduced. The diameter of the disk of the least confusion, d, caused by the spherical aberration which is most dominant in aberrations of the main lens is expressed as:

$$d=\tfrac{1}{2}MC_{SP}\alpha_1^3$$

where $\alpha_1$ is the incident angle of the beam, M is the lens magnification and $C_{SP}$ is the coefficient of spherical aberration. The equation indicates that the spherical aberration can be reduced by reducing the beam incident angle.

Accordingly, by weakening the converging effect of the main lens, the lens magnification and spherical aberration can be reduced, resulting in the improved focusing characteristics. One method for weakening the converging effect is to provide larger diameters for the apertures of the G3 and G4 electrodes and corresponding inner cylinders. (For simplicity purposes, the phrasing "aperture diameter" in the following description also includes the meaning of the diameter of the inner cylinder.)

As shown in FIG. 1, the in-line electron gun has three main lenses for red, green and blue arranged on a plane, and therefore the aperture diameter must be within $\frac{1}{3}$ of the inner diameter of the neck of the glass envelope 1 accommodating the electron gun. The allowable dimension will further be reduced when the thickness of the electrode and its machining accuracy are considered. An enlarged inner diameter of the neck for easing the dimensional restriction causes the deflection power loss to increase, and an enlarged aperture diameter needs, in general, a larger distance between the apertures, resulting in a deterioration of the converging characteristics. Taking these matters into account, the aperture diameters have been made, in general, as large as possible, and it is very difficult to further increase the dimension.

A publication of Japanese Patent Laid-open No. 55-17963 discloses a method for enlarging the above-mentioned aperture diameter over the above-mentioned limit. In this method, the overlapping portion of the apertures which is produced by making the aperture diameter larger than the distance between the adjacent apertures, and there is further provided with a partition plate for potential modification at the overlapping portion.

However, this method also has a limit of aperture diameter. The critical value L of the aperture diameter is given as:

$$L=h-2S \quad (1)$$

where h is the horizontal dimension (in the alignment direction of the three apertures for conducting the electron beams) of the G3 electrode, and S is the distance between the apertures. In practice, the critical dimension will be much smaller due to the machining accuracy of the electrodes.

It is an object of the present invention to provide an electron gun for a color picture tube for the case where the dimensions of the main lenses are restricted by the inner diameter of the neck and the interval of the lenses is determined depending on factors such as the converging characteristics, so that the effective diameter of the lenses can be increased, thereby improving the focusing characteristics.

In order to achieve the object, the inventive structure features to have electrode plates constituting the confronting surfaces of the G3 and G4 electrodes recessed relatively inside the envelopes. This arrangement allows the penetration of a high potential on the G4 electrode deep into the G3 electrode, and a low potential on the G3 electrode into the G4 electrode. Such penetrations of potential have the same meaning effectively as of the enlarged apertures in the confronting surfaces, i.e., the effective diameter is increased. However, the cross-section of the envelopes with their confronting surfaces for the G3 and G4 electrodes being removed is not circular, but has a horizontal dimension larger than the vertical dimension. Accordingly, a larger potential penetration occurs in the horizontal direction, resulting in a larger effective dimension in the horizontal direction than the effective dimension in the vertical direction. This causes the horizontal converging effect of the lens to become weaker than the vertical one, creating the astigmatism in converging the electron beam. The inventive structure features to have on the above-mentioned recessed electrode plates a means for correcting the non-rotational symmetry or rotational asymmetry of the lens caused by the recessed electrode plates themselves, so that the horizontal and vertical converging effects of the lens are made equal thereby to eliminate astigmatism.

According to the invention, the confronting electrode plates are recessed and their structure is designed properly, whereby the same effect as of an increased aperture diameter, the converging effect of the lens is weakened, and thus the focusing characteristics are improved.

Moreover, the outer electron beams are forced to converge inwardly, allowing static convergence even if the central axes of the apertures of the G3 and G4 electrodes are not eccentric from each other. This is because the potential inside the G3 electrode is low in the outer periphery, while it is high in the central section where the high potential of the G4 electrode penetrates deeply, creating an electric field from the outer periphery into the G3 electrode.

The electron gun according to the present invention has no overlapping sections of apertures for conducting the electron beam and does not need a partition plate for potential modification, presenting a distinct electrode structure from those disclosed in the above-mentioned patent Laid-open No. 55-17963.

The present invention will be apparent from the following detailed description taken in conjunction with the accompanying drawings, in which:

FIG. 1 is a cross-sectional view showing in brief the conventional in-line type color picture tube;

FIGS. 2*a* and 2*b* are cross-sectional views showing the principal portions of the first-embodiment electron gun according to the present invention;

Figure 9A:
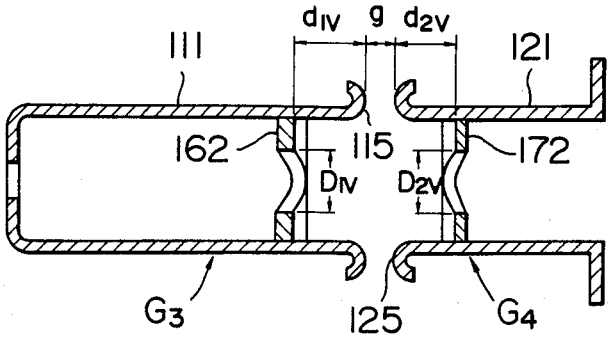
Figure 9B:
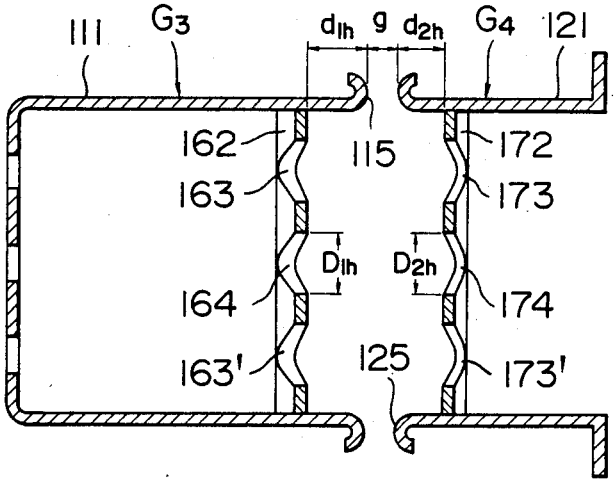
Figure 10:
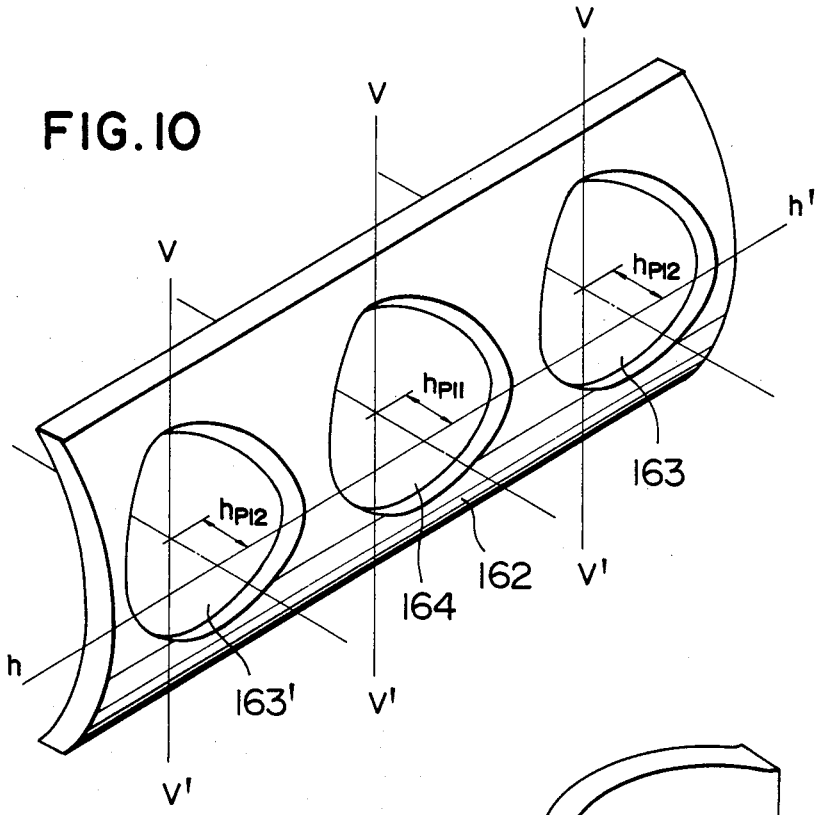
Figure 11:
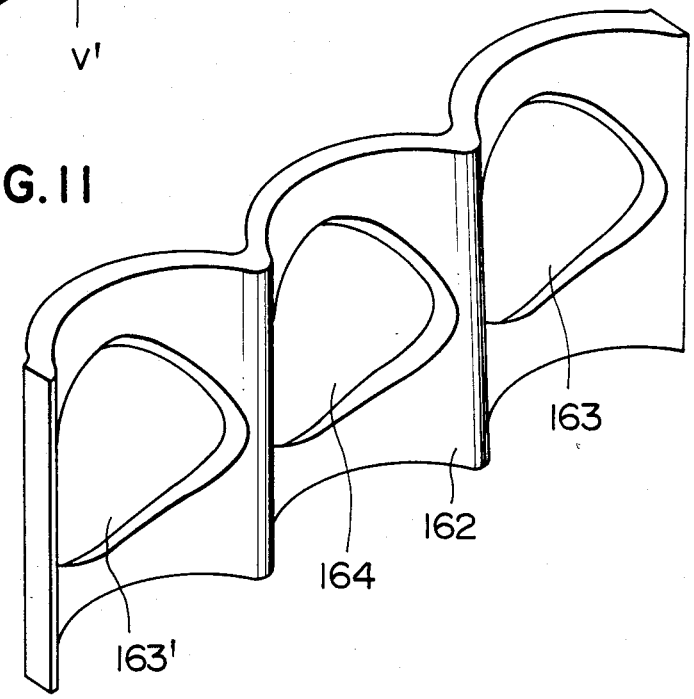
Figure 12A:
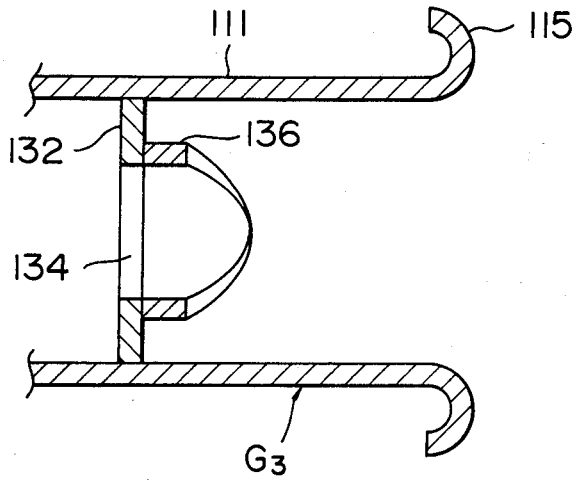
Figure 12B:
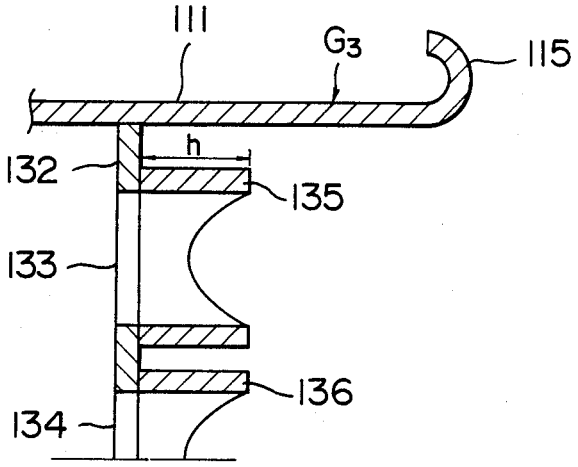
Figure 14:
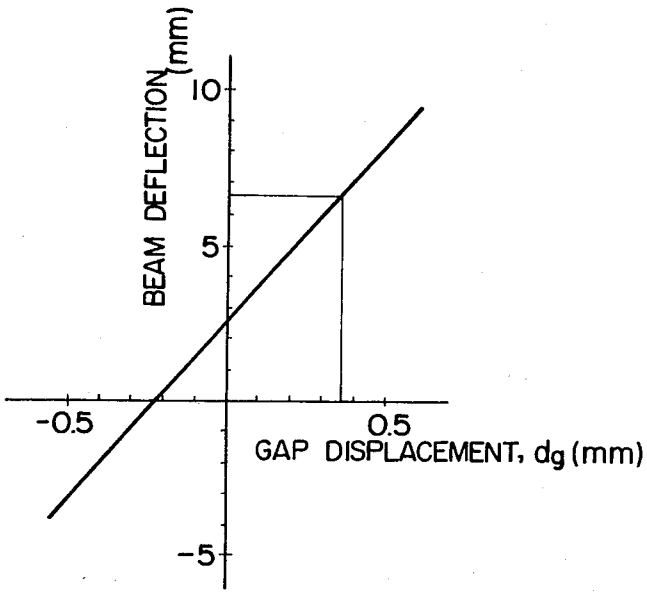
Figure 13:
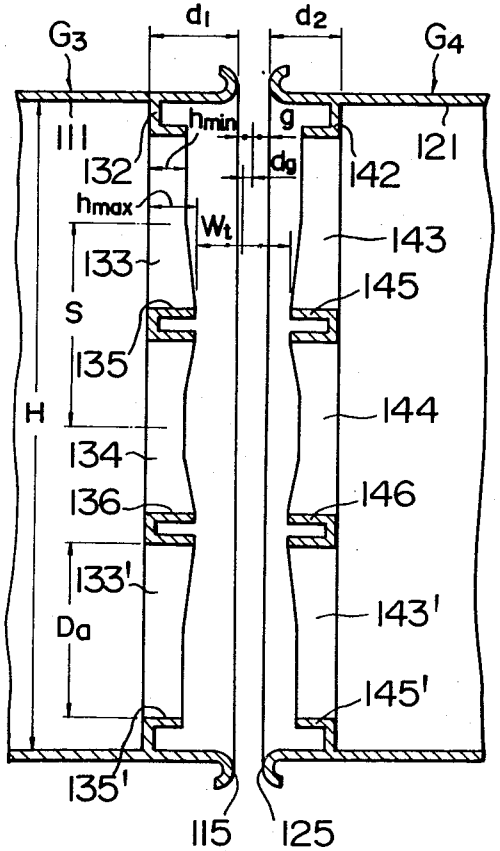
Figure 15:
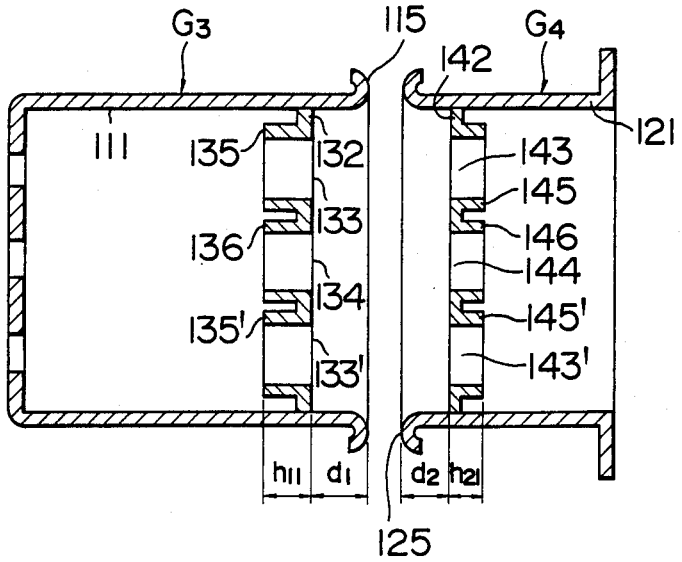
Figure 16:
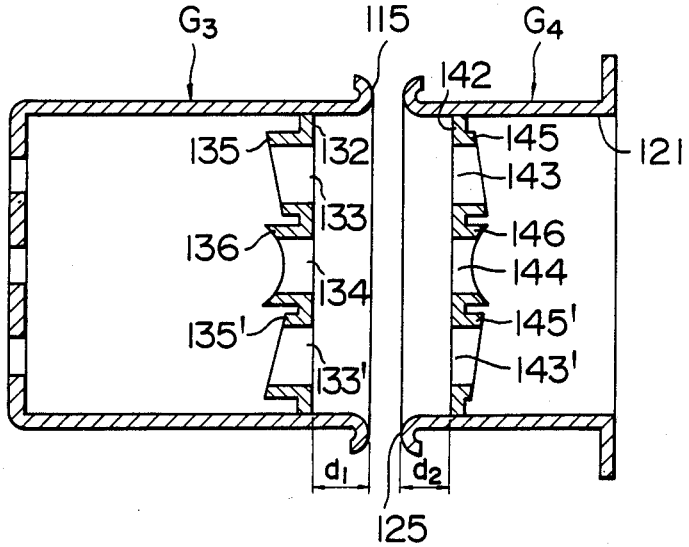

FIGS. 5, 6, 7, 8*a* and 8*b* are cross-sectional views showing the principal portions of the modified versions of the first embodiment of the present invention;

FIGS. 9*a* and 9*b* are cross-sectional views showing the principal portions of the second embodiment of the present invention;

FIGS. 10 and 11 are perspective views each showing an electrode plate used in the second embodiment;

FIGS. 12*a* and 12*b* are cross-sectional views showing the principal portions of the third embodiments of the present invention;

FIG. 13 is a cross-sectional view showing the principal portion of the fourth embodiment of the present invention;

FIG. 14 is a graphical representation showing the gap displacement value and the beam deflection value; and FIGS. 15 and 16 are cross-sectional views showing the principal portions of still other embodiments of the present invention.

Figure 2A:
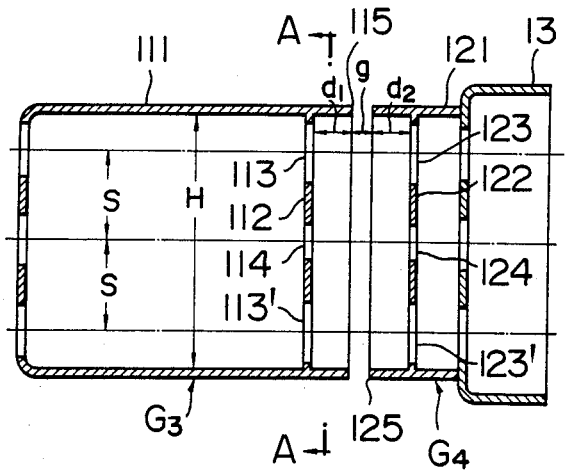
Figure 2B:
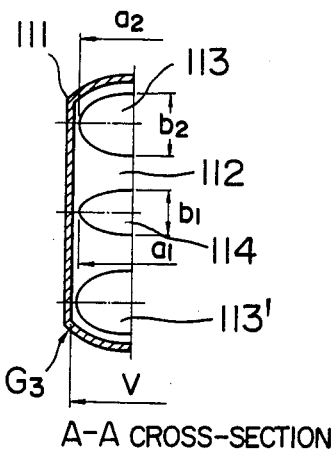

FIGS. 2*a* and 2*b* are the principal cross-sectional views of the first embodiment of the inventive electron gun, wherein the apertures formed in the recessed electrodes have a non-circular shape with its horizontal dimension being smaller than the vertical dimension so that potential penetration in the horizontal direction is suppressed thereby to modify asymmetry. FIG. 2*a* shows the horizontal cross-section of the G3 and G4 electrodes which constitute a main lens of the bi-potential focusing (BPF) type, and FIG. 2*b* is a cross-sectional view taken along the line A—A in FIG. 2*a*, showing the shape of the apertures formed in the electrode. Here, the term "horizontal" or "horizontal direction" means the alignment direction of the three apertures where the electron beam pass through, and the term "vertical" or "vertical direction" means the direction perpendicular to the alignment direction. In the figure, reference numbers 111 and 121 denote the envelopes of the G3 and G4 electrodes, respectively, and 13 denotes the cup electrode. The G3 electrode has an electrode plate 112 for correcting astigmatism provided inside the envelope 111, and the G4 electrode also has an astigmatism correcting electrode plate 122 inside the envelope 121. The electrode plate 112 has an aperture 114 where the central beam passes through and apertures 113 and 113' where the outer beams pass through, and the electrode plate 122 has an aperture 124 where the central beam passes through and apertures 123 and 123' where the outer beams pass through, each aperture set aligning on a line. In this embodiment, the apertures 113, 113', 114, 123, 123', and 124 are formed in an elliptical shape with the horizontal dimension smaller than the vertical dimension, and each set of apertures confronting each other on the G3 and G4 sides has the same shape and dimensions. If the outer apertures 113, 113', 123 and 123' were to have the same shape and dimensions as those of the central apertures 114 and 124, the outer main lenses would have an excessive horizontal converging effect, and therefore, the outer apertures are made to have a larger horizontal dimension than that of the central apertures.

The G3 and G4 electrodes structured as described above are placed oppositely as shown in the figure, and certain voltage are applied to them respectively. (In general, the G3 electrode is supplied at lower voltage than that of the G4 electrode), and an electron lens is formed between the electrodes. This lens has the following portions. A large lens is formed between rims 115 and 125 of the envelopes due to the recessed electrode plates 112 and 124, and small lenses are formed at the apertures 113, 113', 144, 123, 123' and 124 in the electrode plates 112 and 122. The lenses formed at the low-potential G3 electrode are convergent lenses, while while the lenses formed at the high-potential G4 electrode are diverging lenses. Envelopes used in general have different dimensions in the horizontal and vertical directions as can be seen in the figure, and therefore the above-mentioned larger lens is a non-rotationally symmetrical lens having stronger converging effect in the vertical direction than that in the horizontal direction. On this account, if the apertures were to have a circular shape, the lenses formed at the apertures would be non-rotationally symmetric due to the effect of the envelopes. In order to correct such non-rotational symmetry of lenses, in this embodiment, the apertures in the recessed electrodes are formed in an elliptical shape with the horizontal dimension smaller than the vertical dimension. The dimensions of the apertures are determined in consideration of the shape of the envelopes and the shape of the adjacent apertures.

Figure 3:
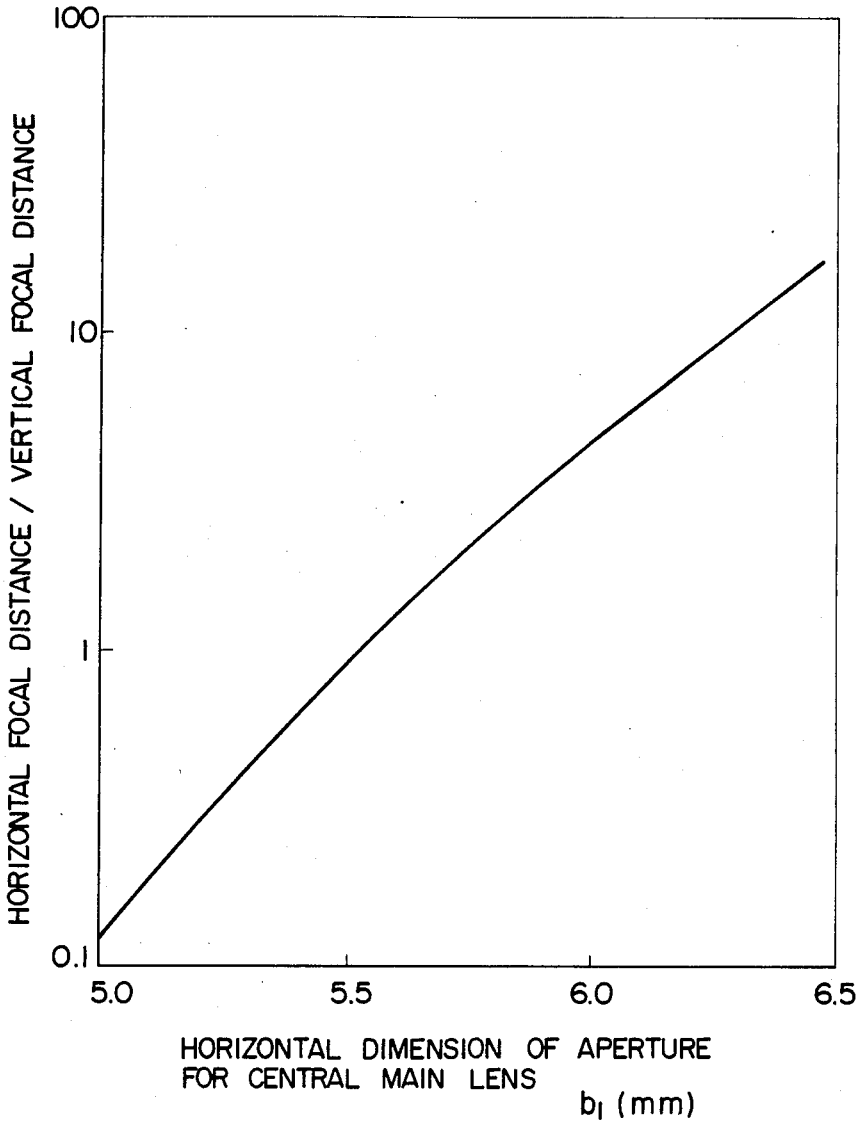
FIG. 3 is a graphical representation showing, as an example, the relationship between the horizontal and vertical focal distances and the horizontal dimension of the aperture for the central main lens of the inventive electron gun.

FIG. 3 shows the ratio of the horizontal to vertical focal distances plotted against the horizontal dimension $b_1$ of the central apertures 114 and 124 basing on the computer simulation for the embodiment shown in FIG. 2 with parameters given as: horizontal dimension of the envelopes 111 and 121, H=20.0 mm; vertical dimension of the envelopes 111 and 121, V=9.4 mm; gap, g=1.0 mm; vertical dimension of the central apertures 114 and 124, $a_1$=8.4 mm; vertical dimension of the outer apertures 113, 113', 123 and 123', $a_2$=8.4 mm; amount recess of the electrode plate 112, $d_1$=1.5 mm; amount of recess of the electrode plate 122, $d_2$=1.5 mm; and distance between the center axes of the apertures, S=6.6 mm.

Here, the horizontal focal distance is defined as being the distance on the central axis between the cross point at which the electron beam emitted from a certain point on the central axis with a certain projection angle is converged by the main lens through the symmetrical axis in the horizontal direction of the central aperture and again crosses the central axis, and the end surface of the G3 electrode at the side opposite to the G4 electrode.

Similarly, the vertical focal distance is defined as being the distance on the central axis between the cross point where the electron beams emitted from a certain point on the central axis with a certain projection angle is converged by the main lens through the symmetrical axis in the vertical direction of the central aperture and again crosses the central axis, and the end surface of the G3 electrode at the side opposite to the G4 electrode. The distance from the end surface to the fluorescent screen is set to be 340 mm, which determines the beam projection angle, and the beam emitting points are determined so that the horizontal and vertical focal distances are equal to 340 mm, then an electron beam is emitted at the mid point of these emitting points at the same projection angle. FIG. 3 shows the ratio of the horizontal focal distance to the vertical focal distance as a result of the measurement. The graph indicates that by setting the horizontal dimension of the central aperture to be $b_1$=5.5 mm, the horizontal and vertical focal distances coincide with each other, making equal converging effects in both directions, and the non-rotational symmetry can be corrected.

The converging effect of the lens in this case is as large as that of cylindrical bi-potential lenses of 8 mm in diameter spaced out by 1 mm. The magnitude is larger than the critical value 6.8 mm for the electrode aperture restricted by equation (1) when H=20.0 mm and S=6.6 mm.

Figure 4:
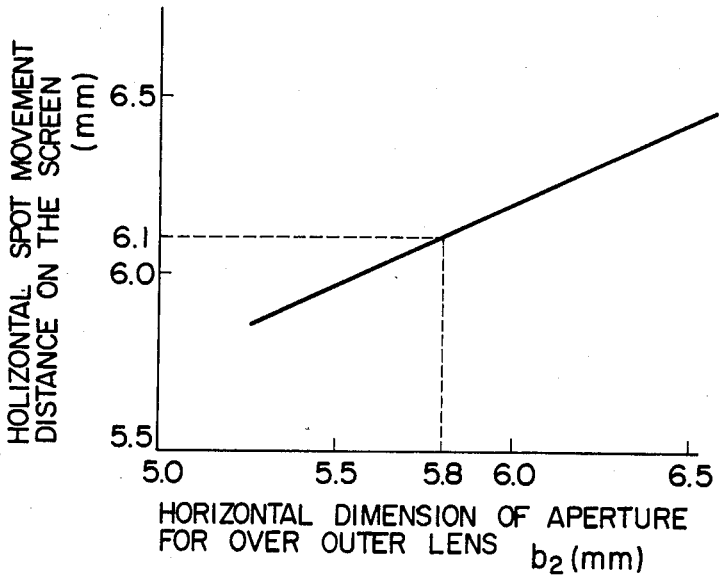
FIG. 4 is a graphical representation showing, as an example, the relationship between the horizontal dimension of the apertures for the outer main lenses and the spot movement distance in the horizontal direction on the fluorescent screen.

FIG. 4 is a plot obtained by computer simulation, showing the relationship between the horizontal dimension $b_2$ of the outer apertures 113, 113', 123 and 123', and the horizontal moving distance of the outer beam spots on the fluorescent screen for the embodiment shown in FIG. 2 with the same dimensions as mentioned above. Voltages of 7 kV and 23 kV are applied to the G3 and G4 electrodes, respectively, and the distance from the end surface on the G4 side of the G3 electrode to the fluorescent screen is set to 340 mm. Since the outer electron beams are spaced out of the central beam by 6.6 mm horizontally, it needs a spot moving distance of 6.6 mm for the static convergence. In practice, the distance is set to around 6.1 mm in order to leave a marginal distance for the color adjustment, and it is obtained by setting $b_2$ to 5.8 mm.

Accordingly, this embodiment allows the static convergence without the arrangement of the eccentric outer apertures formed in the G3 and G4 electrodes constituting the main lens, but by choosing properly the amount of recess for the electrode plates and the shape of apertures formed in the plates. Moreover, this arrangement allows the use of the same tools for assembling the G3 and G4 electrodes, that improves the assembling accuracy, and the electron gun having stable focusing characteristics can readily be realized.

Figure 5:
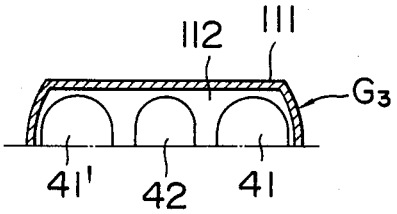

FIG. 5 is a cross-sectional view of the modified version of the first embodiment, showing the shape of apertures formed in the recessed electrode plate of the G3 electrode. Apertures 41, 41' and 42 formed in the recessed electrode plate 112 are shaped such that the end points of two arcs are connected by two parallel lines. Although this arrangement provides an inferior spot shape on the fluorescent screen as compared with the case of the elliptical apertures, it has the advantage that the apertures formed by arcs and straight lines can easily be machined accurately. Also in the modified embodiment, each aperture has a smaller horizontal dimension than the vertical dimension. Electrode plate 122 for the G4 electrode has the same shape as of the electrode plate 112.

Figure 6:
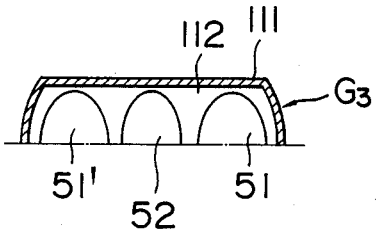
Figure 7:
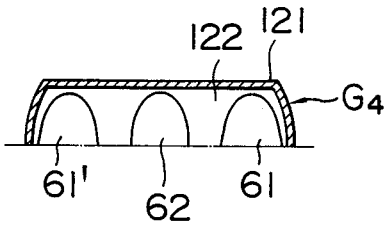

FIGS. 6 and 7 are cross-sectional views of another modified version of the first embodiment, showing the shapes of apertures formed in the G3 and G4 electrodes, respectively. Central apertures 52 and 62 have respective symmetric axes in the vertical direction, but outer apertures 51, 51', 52 and 52' have no vertical symmetric axes. Each of the outer apertures 51, 51', 52 and 52' are formed by combination of two ellipses having the same major axes and different minor axes, and the ellipse located on the outer side of the outer apertures 51 and 51' in the G3 electrode has a smaller minor axis than that of the ellipsoid located inside. Such shaping for the outer apertures in the G3 electrode provides a stronger beam converging force toward the center of the central main lens than in the case of the single ellipse arrangement, allowing the static convergence even with a smaller horizontal dimension of the apertures. Conversely, when the outer apertures of the G4 electrode are formed by combination of two ellipses with the inner ellipse having a smaller minor axis than that of the outer ellipse, a stronger beam converging force toward the central axis of the central main lens is obtained.

Accordingly, by making the outer apertures asymmetric in the vertical direction, the electron beams are converged more strongly and static convergence is made easy. If the beam converging force is too strong, it can be weakened by using the apertures of FIG. 6 for the G4 electrode and the apertures of FIG. 7 for the G3 electrode.

Figure 1:
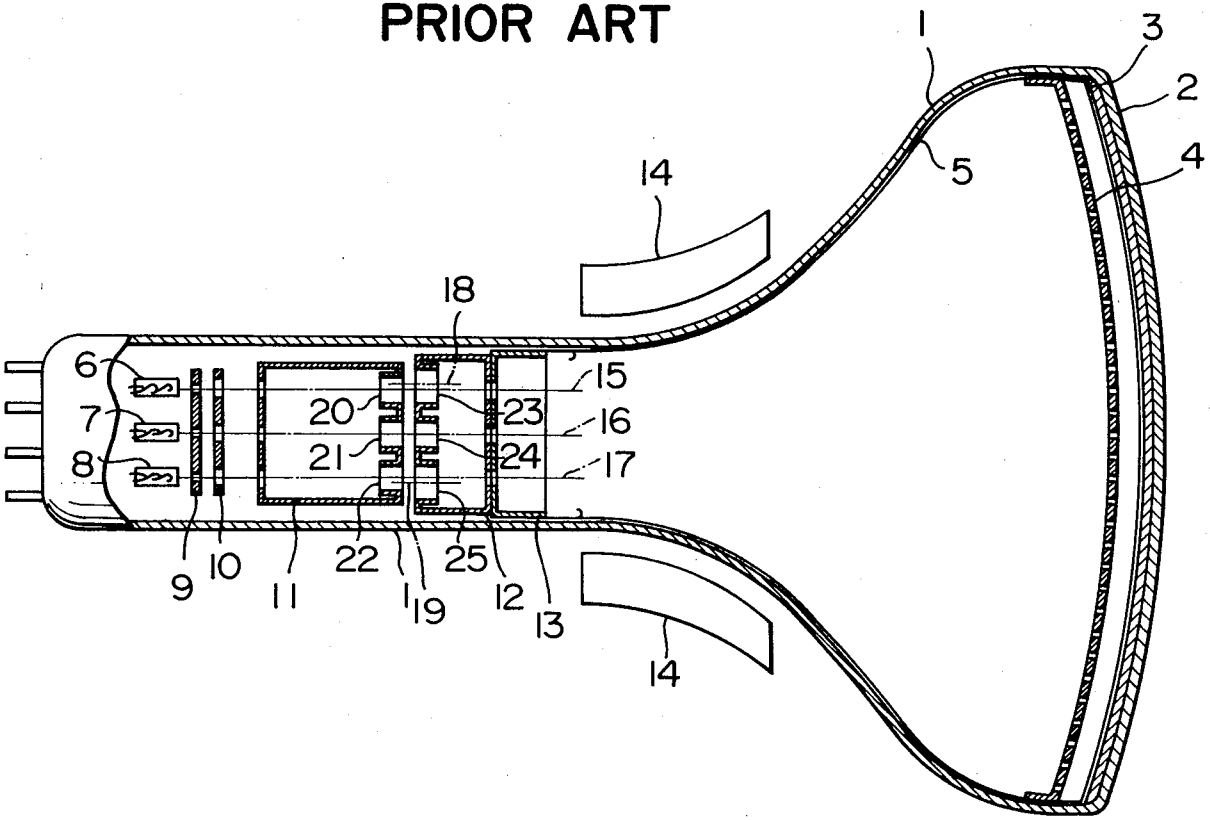
FIG. 1 PRIOR ART
Figure 8A:
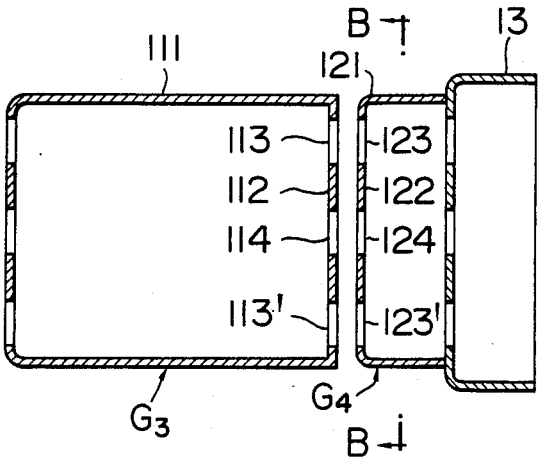
Figure 8B:
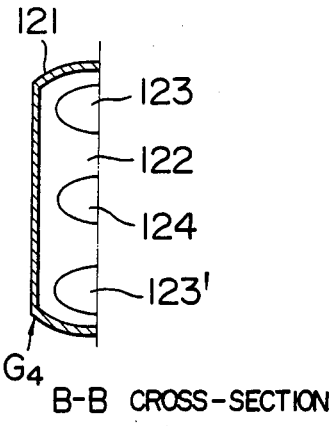

FIGS. 8*a* and 8*b* show the cross-sections of another embodiment of the present invention, wherein the electrode plates 112 and 122 are not recessed, but located on the respective same planes as of the confronting surfaces of the envelopes. FIG. 8*a* is a horizontal cross-sectional view, and FIG. 8*b* is a cross-sectional view taken along the line B—B in FIG. 8*a*, showing the shape of apertures formed in the electrode plate. In this arrangement, apertures 113, 113', 114, 123, 123' and 124 are elliptically shaped so as to correct the non-rotational symmetry. Because the electrode plates are not recessed in this embodiment, the counter electrode potential does not penetrate deeply into the electrode as compared with the arrangements shown in FIGS. 2, 5, 6, and 7. However, the inner cylinders used in the conventional arrangement shown in FIG. 1 are eliminated, allowing deeper penetration of the counter electrode potential than the conventional case, and thus the same effect as of the increased aperture dimensions can be reached to some extent and the focusing characteristics are improved. The arrangement of FIG. 8 has the advantage that the envelope and the electrode plate can easily be formed simultaneously by pressing.

FIG. 9 is a set of cross-sectional views of the second embodiment of the inventive electron gun, showing the vertical cross-section in FIG. 9*a* and the horizontal cross-sectional in FIG. 9*b* of the G3 and G4 electrode pair constituting a bi-potential type main lens. The arrangement contemplates to correct the non-rotational symmetry of the lens caused by the recess of the electrode plates by virture of varying the amount of recess along the periphery of the aperture.

The G3 electrode has three apertures 163, 164 and 163' for conducting electron beams for red, green and blue formed in an electrode plate 162 disposed at a recessed position inside the envelope 111, and similarly the G4 electrode has apertures 173, 174 and 173' formed in an electrode plate 172 disposed at a recessed position inside the envelope 121. The central apertures 164 and 174 and the outer apertures 163 and 173, and 163' and 173' provided in both electrode plates have respective common central axes so that the electron beams can pass through easily. In this embodiment, the apertures are made to have the horizontal dimensions $D_{1h}$ and $D_{2h}$ equal to the vertical dimensions $D_{1v}$ and $D_{2v}$, respectively, and the amounts of recess for the electrode plate in the vertical direction, $d_{1v}$ and $d_{2v}$, are made different from those in the horizontal direction, $d_{1h}$ and $d_{2h}$, so that the effects of the envelopes cancel thereby to correct the non-rotational symmetry.

The amount of recess for the electrode plates in directions other than the vertical and horizontal directions needs to be determined in consideration of the shape of the envelopes and the effect of the adjacent apertures, and the electrode plates are formed in curved surfaces in the periphery of the apertures.

FIG. 10 is a perspective view of an example of the electrode plate, showing the electrode plate 162 for the G3 electrode used in the embodiment shown in FIG. 9.

The electrode plate 162 according to this embodiment is formed on a curved surface which curves in the vertical direction and extends straight in the horizontal direction with apertures 163, 164 and 163' formed therein so that their images projected to a plane perpendicular to each beam axis (central axis of each aperture) form circles. The distance between the horizontal line h–h' connecting the rims of the apertures at the center and the vertical line v–v' connecting the rims at the center, i.e., the height of the surface, $h_{p11}$ ($h_{p12}$), is equal to the difference of $d_{1h}$ and $d_{1v}$ shown in FIG. 9*a* and 9*b*. Although the surface shown in FIG. 10 extends straight in the horizontal direction, resulting in $h_{p11}=h_{p12}$, it may be made to curve in the horizontal direction so that $h_{p11}$ is unequal to $h_{p12}$.

FIG. 11 is a perspective view of another example of the electrode plate used in the embodiments for correcting the non-rotational symmetry by varying the amount of recess of the electrode plates, showing the electrode plate 162 for the G3 electrode as in the case of FIG. 10. In this embodiment, the electrode plate 162 has individual curved surfaces for the three beams, and each surface curves in the horizontal direction and extends straight in the vertical direction. This arrangement has the advantage that each surface can be formed independently to have lens characteristics which meet the nature of each beam.

As described in FIGS. 9*a*, 9*b*, 10 and 11, in the case of correcting the non-rotational symmetry by varying the amount of recess for the electrode plates, the shape of apertures formed in the electrode plates can be substantially circular, which does not require the machining of special shapes in manufacturing assembling tools, and the main lens can be assembled accurately.

In the foregoing embodiments, the electrode plate 172 for the G4 electrode has not been described in detail, but it may be formed identically to the electrode plate 162 for the G3 electrode as shown in FIG. 10 or 11 and disposed oppositely to the electrode plate 162.

In the embodiments of FIGS. 10 and 11, the apertures are simply punched, however, they may be formed into cylinders by pushing for the purpose of smoothing their rims, without losing the effect of the present invention. In this case, the pushed-out cylinders will slightly affect the determination of the recess amount for the electrode plates.

FIGS. 12*a* and 12*b* are the principal cross-sectional views of the third embodiment of the inventive electron gun, showing the vertical cross section of the G3 electrode in FIG. 12*a* and the horizontal cross section of the same in FIG. 12*b*. This embodiment is based on the fact that the main factor of determining the characteristics of the lens resides in the shape of the rim of apertures in the electrode plates and that the distance from a plane in contact with the end of the envelope to the rim of apertures differs, importantly, depends on the peripheral direction. The embodiment contemplates to correct the non-rotational symmetry of the lens by means of a cylinder provided in each aperture of the recessed electrode plates.

The G3 electrode has three apertures 133, 134, and 133' (not shown) for conducting electron beams for red, green and blue, respectively, formed in the electrode plate 132 which is disposed at a recessed position inside the envelope 111. These apertures are provided with cylinders 135, 136, and 135' (not shown) projecting toward the G4 electrode (not shown). In this embodiment, the apertures are shaped as a circle, and the cylinders having inner diameters equal to the respective apertures are located coaxially. Each of the cylinders has the varying height which varies depending on the circumferential position, and it is determined in consideration of the shape of the envelope and the effect of the adjacent cylinder as in the cases of the foregoing first and second embodiments. In FIG. 12*b*, the height h of each cylinder is higher in the horizontal direction than in the vertical direction so that the end of the cylinder confronting the G4 electrode forms a curved surface. In more detail, each cylinder has the maximum height at the points on the horizontal line intersecting the central axis of the cylinder, has the height which decreases gradually as the point goes along the circumferential surface, and has the minimum height at the points on the vertical line intersecting the central axis of the cylinder, as shown in FIGS. 12*a* and 12*b*.

Although the G4 electrode of this embodiment is not described, it may be arranged such that the electrode plate is disposed at a recessed position inside the envelope with cylinders provided at the apertures of the plate as in the case of the G3 electrode the cylinders projecting toward the G3 electrode, or the electrode plate may be disposed simply at the end of the envelope as in the conventional arrangement.

FIG. 13 is the principal cross-sectional view of the fourth embodiment of the inventive electron gun, showing the horizontal cross section of the G3 and G4 electrodes constituting the main lens. This embodiment contemplates to correct the non-rotational symmetry of the lens by provision of cylinders at the apertures formed in the electrode plates as in the case of the foregoing third embodiment. Specifically, in this embodiment, the non-rotational symmetry of the lens is corrected and the desired static convergence is obtained by the adjustment of the height of the cylinders.

As shown in the figure, the G3 electrode has almost the same structure as that of FIG. 12 with the only difference being that the cylinders 135, 136 and 135' provided at the apertures 133, 134 and 133' in the electrode plate 132 form curved surfaces at their ends in a different shape from the previous case, and explanation thereof will be omitted. The G4 electrode is arranged such that an electrode plate 142 is disposed at a recess position inside the envelope 121 with three apertures 143, 144 and 143' for conducting electron beams formed in the plate as in the case of the G3 electrode. These apertures are provided with cylinders 145, 146 and 145' projecting toward the G3 electrode. The apertures are shaped as circles and their central axes coincide with the central axes of the corresponding apertures formed in the G3 electrode. The cylinders have inner diameters equal to the respective apertures, and are located coaxially.

In this embodiment, cylinders 135, 136, 135', 145, 146, and 146' provided on the G3 and G4 electrodes have the varying height along the circumference such that lenses formed between confronting cylinder pairs become rotationally symmetric. In determining the height of each cylinder, consideration must be made for the shape of the envelopes and the effect of the adjacent cylinders, and specifically for the cylinders 135, 135', 145 and 145' for conducting the outer electron beams need to have a larger height on the side of the central beam and a smaller height on the side of the envelope wall in order to obtain the static convergence. Each of the outer cylinders 135, 135', 145 and 145' has the minimum height at the point on the side of the envelope wall on the horizontal line intersecting the central axis of the cylinder and the maximum height at the point on the side of the central beam on the same line, has the constant height in circumferential sections from the point on the side of the envelope wall to the points on the vertical line intersecting the central axis of the cylinder, and has the increasing height in circumferential sections from the points on the vertical line to the second-mentioned point on the side of the central beam on the line. Each of the central cylinders 136 and 146 has the maximum height at the points on the horizontal line intersecting the central axis of the cylinder, has the decreasing height as the position goes from these points toward the points on the vertical line intersecting the central axis of the cylinder including a section of the constant height between the points, and has the minimum height at the points on the vertical line.

The following will describe the method of providing a satisfactory static convergence for the outer electron beams. In order to deflect the electron beams as required for the static convergence, it is necessary to form "electron prisms" in the main lens. In this embodiment, the outer electron beams pass through portions near the rim of the large lens which is formed between the rims 115 and 125 of the envelopes 111 and 121, and the static convergence is achieved by utilization of the converging force by the lens. Observation of the electron beam converged by the large lens indicates that the beam is subjected to the converging force in the proximity of the low-potential electrode (G2 electrode) and subjected to the diverting force in the proximity of the high-potential electrode, resulting in a converging deflection in total. Accordingly, by moving the cylinder position in the axial direction relative to the confronting end surfaces of the envelopes by adjusting the amount of recess of the electrode plates so as to control the effect (the ratio of the converging force and the diverting force) of the lens on the electron beam, the amount of deflection for the electron beam can be controlled and the desired static convergence can be achieved.

FIG. 14 shows the amount of deflection of the electron beam plotted against the amounts of recess $d_1$ and $d_2$ for the electrode plates, while maintaining the shape of each cylinder. During the measurement, $d_1$ and $d_2$ were varied simultaneously so that the distance $w_t$ between the cylinders 135 and 145, and between 135' and 145' is kept constant. Parameters were given as: inner diameter of each cylinder, $D_a=5.5$ mm; distance of cylinders, $S=6.6$ mm, horizontal dimension of envelopes 111 and 121, $H=20.0$ mm; vertical dimension of envelopes 111 and 121, V=9.4 mm; maximum height of each cylinder, $h_{max}$=1.5 mm; minimum height, $h_{min}$=1.0 mm; gap between envelopes, g=1.0 mm; distance from the end surface 115 of envelope 111 to fluorescent screen: 340 mm; application voltage to G3 electrode; 7 kV; and application voltage to G4 electrode: 25 kV. The gap displacement $d_g$ is defined as the distance from the center of the inter-envelope gap g to the center of the inter-cylinder gap $w_t$, representing the difference of two gap centers, and it is signed positively when the inter-cylinder gap is moved toward the G3 electrode. The amount of beam deflection is defined as the swing of the electrode beam on the fluorescent screen, and it is signed positively when the beam swings toward the central beam. In this embodiment, the distance S is 6.6 mm, and the outer beams coincide with the central beam on the fluorescent screen with a beam deflection of 6.6 mm, providing a correct static convergence. FIG. 14 indicates that this condition is reached when $d_g$ is 0.36 mm. That is, by moving the inter-cylinder gap toward the G3 electrode, i.e., by making the recess $d_1$ for the electrode plate 132 of G3 larger than the recess $d_2$ of the electrode plate 142 of G4, so as to cause the large lens to produce a strong converging force, the sufficient deflection force for the static convergence can be obtained. According to this embodiment, the beam deflection force necessary for the static convergence can readily be obtained by the adjustment of the positional relationship between the inter-cylinder gap and the inter-envelope gap.

FIGS. 15 and 16 are cross-sectional views of other embodiments, wherein cylinders 135, 136, 135', 145, 146, and 145' are provided so that they project away from the confronting surface of each envelope as opposed to the embodiments shown in FIGS. 12 and 13. The arrangement of FIG. 15, contemplates to correct non-rotationally symmetry and achieve the static convergence at the same time by providing a constant height $h_{11}$ and recess $d_1$ for the cylinders 135, 136 and 135', and different height $h_{21}$ and recess $d_2$ for the cylinders 145, 146 and 145'. The static convergence largely depends on the values of recess $d_1$ and $d_2$, and therefore it is important to determine the $d_1$ and $d_2$ in consideration of the effect of each lens on the electron beam as well as the deflection effect on the outer electron beams. It is desirable to make $d_1$ larger than $d_2$ as in the embodiment of FIG. 13, and it is also desirable to make height $h_{11}$ larger than $h_{21}$. In case the amounts of recess $d_1$ and $d_2$ differ too much, the height of cylinder 136 or 146 necessary for compensating non-rotational symmetry of the central lens and the height of cylinders 135 and 135', or 145 and 145' necessary for compensating the outer lenses may not become constant as mentioned in connection with FIG. 15 ($h_{11}$ and $h_{21}$), and in this case, both compensations can be achieved by varying the height of each cylinder along the circumferential direction. Even in this case, the cylinders have preferably a substantially identical average height. In determining the values of $d_1$, $d_2$, $h_{11}$ and $h_{21}$, many factors such as the shape of envelopes and the strength of the lenses to be obtained need to be considered as in the cases of the foregoing embodiments.

FIG. 16 shows a modified version of the embodiment shown in FIG. 15. In case the opening of the envelope has a flattened cross section or an electrode plate with a large circular aperture is disposed inside the envelope having a small opening area, the envelope has complicated effects on the characteristics of the electron lens, causing possibly the electron lens structured as shown in FIG. 15 to be compensated sufficiently for non-rotational symmetry. This modified embodiment has a structure suitable for use in such cases, wherein non-rotational symmetry which is not compensated completely by the adjustment of the recess for the electrode plate and the height of the cylinders is covered by varying the shape of the end of the cylinders. Varying the height of each cylinder along the circumferential direction can compensate the complicated effects of the envelopes.

In this embodiment, each of the outer cylinders 135 and 135' for the G3 electrode has the maximum height at the point on the side of the envelope wall on the horizontal line intersecting the central axis of the cylinder, has the decreasing height as the point moves from the above-mentioned point along the circumference, and the minimum height at the point on the side of the central beam on the horizontal line. Each of the outer cylinders 145 and 145' for the G4 electrode, as opposed to the case of the cylinders 135 and 135', has the minimum height at the point on the side of the envelope wall on the horizontal line, has the increasing height as the point moves from that point along the circumference, and has the maximum height at the point on the side of the central beam on the horizontal line, and these cylinders have openings which are cur aslant. Each of the central cylinders 136 and 146 has the maximum height at the points on the side of both outer beams on the horizontal line intersecting the central axis of the cylinder, has the decreasing height as the points move from the above-mentioned points along the circumference, and has the minimum height at the points on the vertical line intersecting the central axis of the cylinder. Also in this embodiment, the recess $d_1$ for the G3 electrode is made larger than the recess $d_2$ for the G4 electrode so as to easily achieve the static convergence, as in the embodiments shown in FIG. 13 and FIG. 15.

The present invention can be applied not only to the main lens of the bi-potential focusing type as described above, but of course be applicable to the main lenses of the uni-potential focusing type and other types. In the foregoing embodiments, the inventive arrangement is applied to both of each electrode pair constituting the main lens, but the similar effect can be obtained when it is applied only to one of each electrode pair. This allows the remaining electrode to introduce another effect in designing and machining the electrode.

What we claim is:

1. An electron gun for a color picture tube having means for emitting three electron beams toward a fluorescent screen, and lenses for focusing said electron beams on said fluorescent screen, characterized in that said lenses are constituted by two electrodes spaced out from each other and adapted to surround said electron beams, each electrode including an electrode plate having three apertures aligned on a line for conducting said electron beams, at least one of said electrode plates being recessed relative to another electrode plate and disposed inside said electrode, said apertures formed in said recessed electrode plate having a smaller dimension in the direction of said alignment of apertures than the dimension in the direction perpendicular to said alignment direction so that non-rotational symmetry of said lenses caused by the recess of said electrode plate is corrected.

2. An electron gun according to claim 1, wherein said apertures formed in said recessed electrode plate have an elliptical shape.

3. An electron gun according to claim 1, wherein said apertures formed in said recessed electrode plate are shaped such that end points of two arcs are connected by two parallel lines perpendicular to said alignment direction.

4. An electron gun according to claim 1, wherein the central aperture out of said apertures formed in said recessed electrode plate has a symmetric axis perpendicular to said alignment direction, while outer apertures do not have symmetric axes parallel to said first-mentioned symmetric axis, said outer apertures being formed so that they are symmetric with each other with respect to respective symmetric axes.

5. An electron gun according to claim 1, wherein said two electrodes have confronting end surfaces, at least said recessed electrode plate of one of said electrodes being disposed to oppose said electrode plate of the other of said two electrodes.

6. An electron gun according to claim 5, wherein the central aperture of said aligned apertures formed in said opposing electrode plates has a symmetric axis perpendicular to said alignment direction, while outer apertures of said opposing electrode plates do not have symmetric axes parallel to said first-mentioned symmetric axis, said outer apertures being formed so that they are symmetric with each other with respect to respective symmetric axes.

7. An electron gun according to claim 5, wherein said apertures formed in said recessed electrode plate have an elliptical shape.

8. An electron gun according to claim 5, wherein said apertures formed in said recessed electrode plate are shaped such that end points of two arcs are connected by two parallel lines perpendicular to said alignment direction.

9. An electron gun for a color picture tube having means for emitting three electron beams toward a fluorescent screen, and lenses for focusing said electron beams on said fluorescent screen, characterized in that said lenses are constituted by two electrodes spaced out from each other and adapted to surround said electron beams, each electrode including an electrode plate having three apertures aligned on a line for conducting said electron beams, at least one of said electrode plates being recessed relative to another electrode plate and disposed inside said electrode, means for correcting non-rotational symmetry of said lenses caused by the recess of electrode plate, said correcting means including a cylinder located coaxially with respect to each aperture, said cylinder having a height varying along the circumferential direction, said two electrodes having confronting end surfaces, at least said recessed electrode plate of one of said electrodes being disposed to oppose said electrode plate of the other of said two electrodes, each of said electrodes having a recessed electrode plate recessed with respect to the confronting end surface of the associated electrode, and said cylinders of said opposing recessed electrode plates extending toward one another.

10. An electron gun for a color picture tube having means for emitting three electron beams toward a fluorescent screen, and lenses for focusing said electron beams on said fluorescent screen, characterized in that said lenses are constituted by two electrodes spaced out from each other and adapted to surround said electron beams, each electrode including an electrode plate having three apertures aligned on a line for conducting said electron beams, at least one of said electrode plates being recessed relative to another electrode plate and disposed inside said electrode, means for correcting non-rotational symmetry of said lenses caused by the recess of said electrode plate, said correcting means including configurating said recessed plate as a curved surface plate with the distance from the recess of each aperture to an end surface of the associated electrode varying along the circumference of said aperture.

11. An electron gun according to claim 10, wherein said recessed electrode plate is formed of a curved surface plate having a curved surface which is common to said apertures formed in said recessed electrode plate.

12. An electron gun according to claim 10, wherein said recessed electrode plate is formed of a curved surface plate having curved surfaces which correspond to said apertures formed in said recessed electrode plate.

* * * * *